US005728959A

United States Patent [19]

O'Rorke

[11] Patent Number: 5,728,959

[45] Date of Patent: Mar. 17, 1998

[54] GUITAR TUNER HOLDER

[76] Inventor: John D. O'Rorke, 1226 Prospect St., Westfield, N.J. 07090

[21] Appl. No.: 764,062

[22] Filed: Nov. 6, 1996

[51] Int. Cl.[6] ..... G10G 7/02

[52] U.S. Cl. ..... 84/453; 84/454; 248/205.2; 248/227.3; 248/230.6; 248/231.71

[58] Field of Search ..... 84/453, 454; 248/205.2, 248/218.4, 227.3, 230.6, 231.71; D17/99

[56] References Cited

U.S. PATENT DOCUMENTS

| | | | |
|---|---|---|---|
| 4,453,488 | 6/1984 | Miesak | 84/454 |
| 4,721,276 | 1/1988 | Moss | 248/205.2 |
| 4,889,029 | 12/1989 | St. Denis | 84/454 |
| 5,007,612 | 4/1991 | Manfre | 248/231.71 |
| 5,165,631 | 11/1992 | Norsworthy . | |

*Primary Examiner*—Cassandra C. Spyrou

[57] ABSTRACT

A new Guitar Tuner Holder for holding an electronic guitar tuner on a microphone stand. The inventive device includes a tuner bracket adapted to securely hold an electronic guitar tuner and a clamping means attached to the tuner bracket for clamping the tuner bracket to a microphone stand. The tuner bracket comprises a shelf portion and a stepped-up portion at one end of the shelf portion for supporting an instrument cable extending from the electronic guitar tuner. A hook and loop fastener is provided for removably and securely holding the electronic guitar tuner on the shelf portion of the tuner bracket. The clamping means includes a pair of opposed C-shaped clamping members and a threaded fastener for compressing and clamping the C-shaped clamping members tightly against the microphone stand. The tuner bracket is positionable at any height along the microphone stand that is comfortable and convenient for the user.

16 Claims, 3 Drawing Sheets

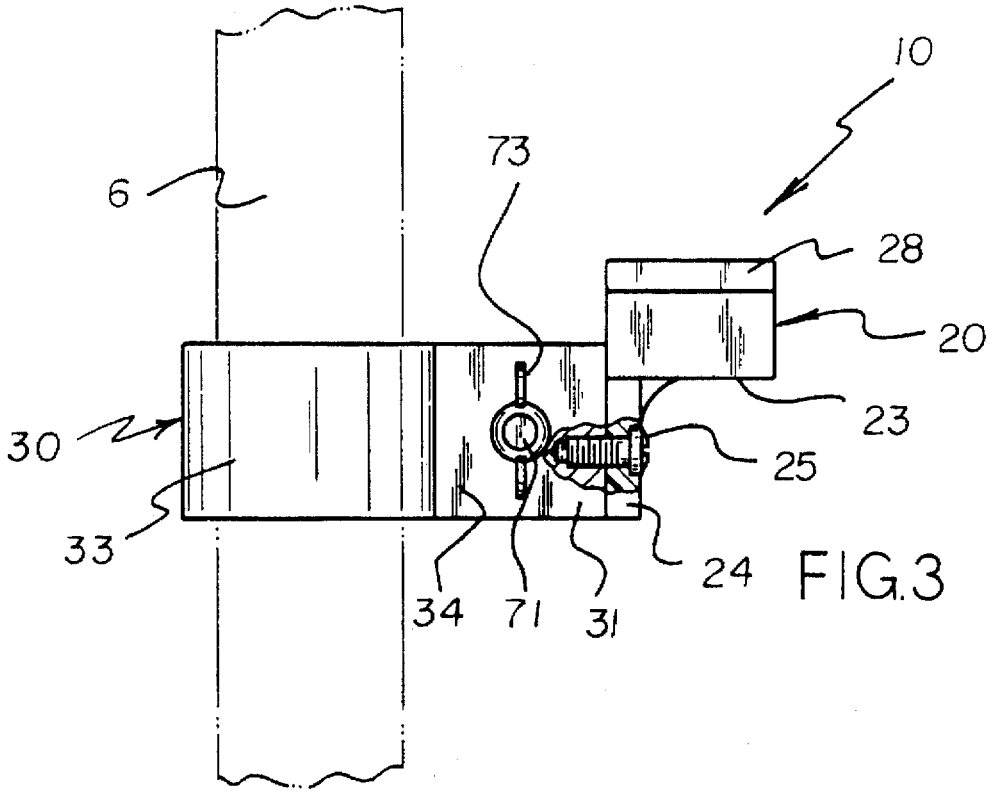
FIG.3
FIG. 4
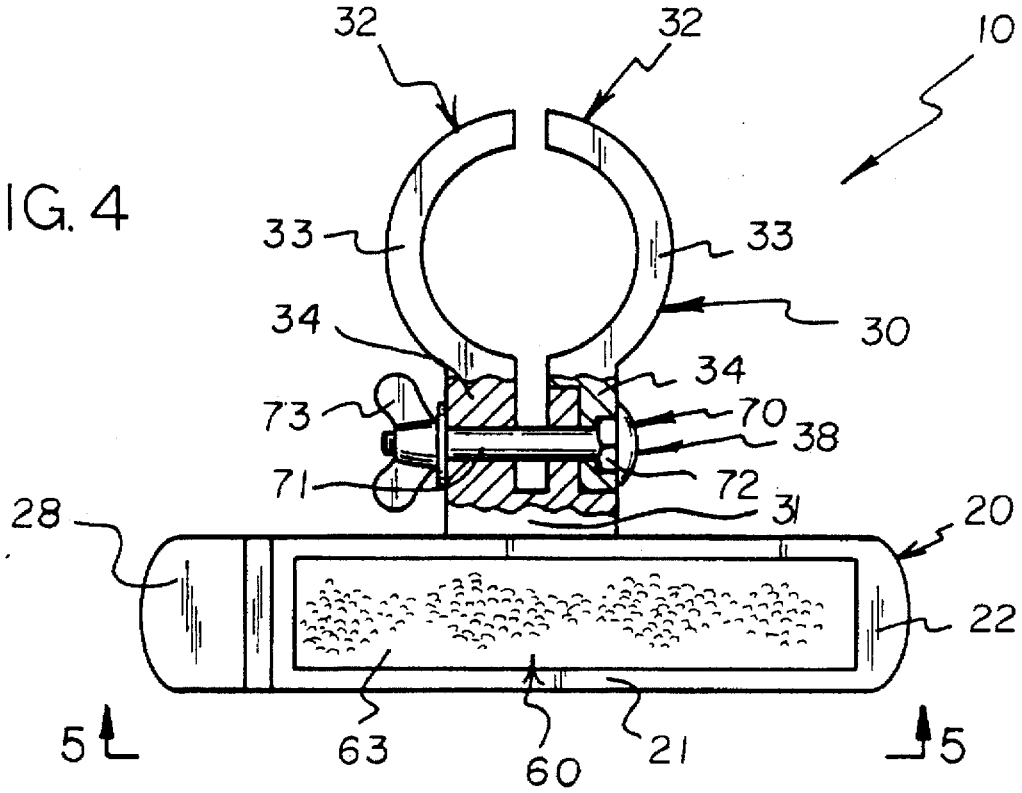

GUITAR TUNER HOLDER

BACKGROUND OF THE INVENTION

1. Field of the Invention

The present invention relates to mountable holders and more particularly pertains to a new Guitar Tuner Holder for holding an electronic guitar tuner on a microphone stand.

2. Description of the Prior Art

The use of mountable holders is known in the prior art. More specifically, mountable holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art mountable holders include U.S. Pat. No. 4,467,693; U.S. Pat. No. 4,501,201; U.S. Pat. No. 4,953,716; U.S. Pat. No. D276,043; U.S. Pat. No. D346,655 and U.S. Pat. No. 4,832,299.

While these devices fulfill their respective, particular objectives and requirements, the aforementioned patents do not disclose a new Guitar Tuner Holder. The inventive device includes a tuner bracket adapted to securely hold an electronic guitar tuner and a clamping means attached to the tuner bracket for clamping the tuner bracket to a microphone stand.

In these respects, the Guitar Tuner Holder according to the present invention substantially departs from the conventional concepts and designs of the prior art, and in so doing provides an apparatus primarily developed for the purpose of holding an electronic guitar tuner on a microphone stand.

SUMMARY OF THE INVENTION

In view of the foregoing disadvantages inherent in the known types of mountable holders now present in the prior art, the present invention provides a new Guitar Tuner Holder construction wherein the same can be utilized for holding an electronic guitar tuner on a microphone stand.

The general purpose of the present invention, which will be described subsequently in greater detail, is to provide a new Guitar Tuner Holder apparatus and method which has many of the advantages of the mountable holders mentioned heretofore and many novel features that result in a new Guitar Tuner Holder which is not anticipated, rendered obvious, suggested, or even implied by any of the prior art mountable holders, either alone or in any combination thereof.

To attain this, the present invention generally comprises a tuner bracket adapted to securely hold an electronic guitar tuner and a clamping means attached to the tuner bracket for clamping the tuner bracket to a microphone stand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Guitar Tuner Holder apparatus and method which has many of the advantages of the mountable holders mentioned heretofore and many novel features that result in a new Guitar Tuner Holder which is not anticipated, rendered obvious, suggested, or even implied by any of the prior art mountable holders, either alone or in any combination thereof.

It is another object of the present invention to provide a new Guitar Tuner Holder which may be easily and efficiently manufactured and marketed.

It is a further object of the present invention to provide a new Guitar Tuner Holder which is of a durable and reliable construction.

An even further object of the present invention is to provide a new Guitar Tuner Holder which is susceptible of a low cost of manufacture with regard to both materials and labor, and which accordingly is then susceptible of low prices of sale to the consuming public, thereby making such Guitar Tuner Holder economically available to the buying public.

Still yet another object of the present invention is to provide a new Guitar Tuner Holder which provides in the apparatuses and methods of the prior art some of the advantages thereof, while simultaneously overcoming some of the disadvantages normally associated therewith.

Still another object of the present invention is to provide a new Guitar Tuner Holder for holding an electronic guitar tuner on a microphone stand.

Yet another object of the present invention is to provide a new Guitar Tuner Holder which includes a tuner bracket adapted to securely hold an electronic guitar tuner and a clamping means attached to the tuner bracket for clamping the tuner bracket to a microphone stand.

Still yet another object of the present invention is to provide a new Guitar Tuner Holder that positions and holds an electronic guitar tuner at a convenient height on a microphone stand thereby allowing a musician to easily tune their guitar at any time.

Even still another object of the present invention is to provide a new Guitar Tuner Holder that eliminates the difficulty of trying to hold an electronic guitar tuner while also tuning a guitar.

Even still another object of the present invention is to provide a new Guitar Tuner Holder that elevates an electronic guitar tuner off the floor and firmly holds the electronic guitar tuner in place on a microphone stand thereby helping to prevent damage to the electronic guitar tuner which may result from stepping on the electronic guitar tuner, or dropping or knocking the electronic guitar tuner from an elevated position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side view of the present invention.

FIG. 4 is a top view of the present invention.

DESCRIPTION OF THE PREFERRED EMBODIMENT

Figure 1:
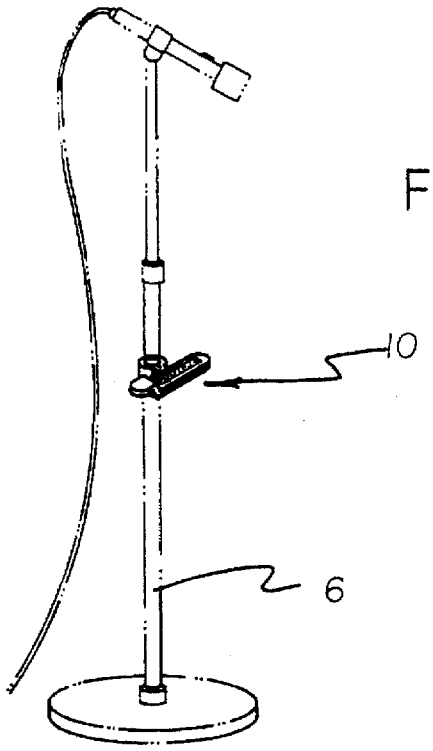
FIG. 1 is an illustration of a new Guitar Tuner Holder attached to a microphone stand according to the present invention.

With reference now to the drawings, and in particular to FIGS. 1 through 6 thereof, a new Guitar Tuner Holder embodying the principles and concepts of the present invention and generally designated by the reference numeral 10 will be described.

More specifically, it will be noted that the Guitar Tuner Holder 10 comprises a tuner bracket 20 adapted to securely hold an electronic guitar tuner 2 and a clamping means 30 attached to the tuner bracket 20 for clamping the tuner bracket 20 to a microphone stand 6.

As best illustrated in FIGS. 2 through 6, it can be shown that the tuner bracket 20 comprises a shelf portion 21 having a top surface 22 and a bottom surface 23, and an attachment portion 24 extending downward from the bottom surface 23 of the shelf portion 21 for attaching the tuner bracket 20 to the clamping means 30. The clamping means 30 comprises a base portion 31, a pair of opposed C-shaped clamping members 32 extending perpendicular from the base portion 31, and a compression means 38 for compressing and clamping the pair of opposed C-shaped clamping members 32 tightly against the microphone stand 6. Fasteners 25 and 26 attach the attachment portion 24 of the tuner bracket 20 to the base portion 31 of the clamping means 30.

Figure 2:
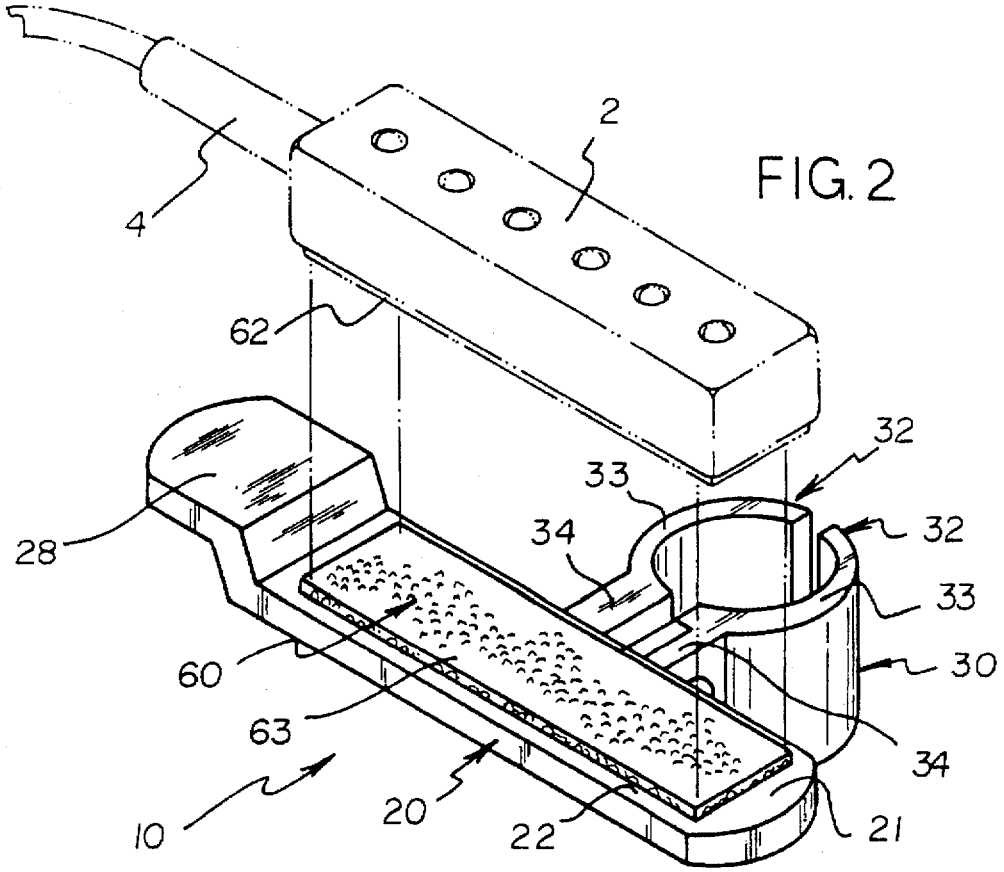
FIG. 2 is an illustration of an electronic guitar tuner and the present invention.

As best illustrated in FIG. 2, it can be shown that a tuner securing means 60 is provided for removably and securely holding the electronic guitar tuner 2 on the shelf portion 21 of the tuner bracket 20. The tuner securing means 60 comprises a hook and loop fastener 61 (i.e., "VELCRO") comprising a hook portion 62 provided on the underside of the electronic guitar tuner 2 and a loop portion 63 provided on the top surface 22 of the shelf portion 21 of the tuner bracket 20.

Figure 5:
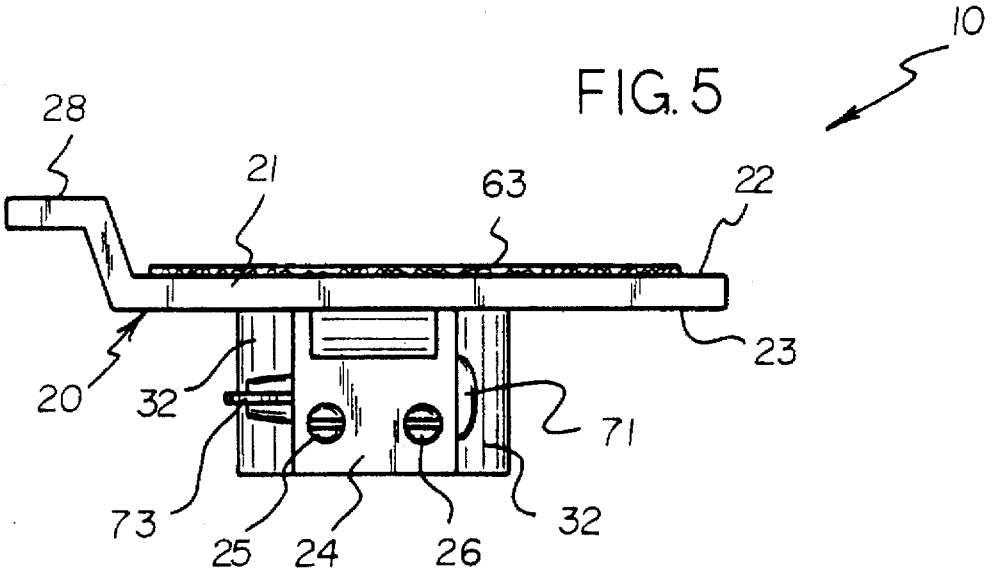
FIG. 5 is an end view from the perspective of line 5—5 of FIG. 3.

As best illustrated in FIGS. 2 and 5, it can be shown that a stepped-up portion 28 is provided at one end of the shelf portion 21 for supporting an instrument cable 4 extending from the electronic guitar tuner 2.

Figure 6:
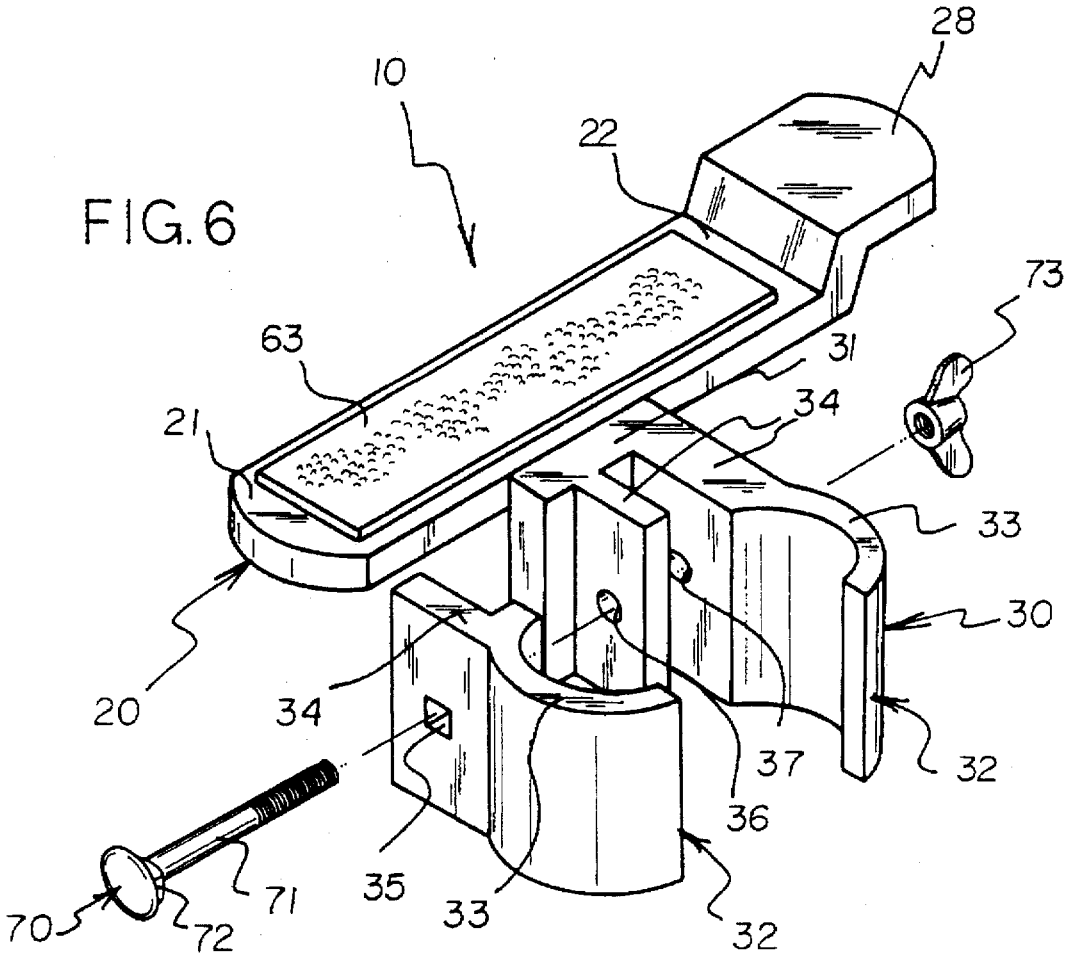
FIG. 6 is a detailed illustration of the clamping means of the present invention.

As best illustrated in FIGS. 4 and 6, it can be shown that each of the C-shaped clamping members 32 comprises a C-shaped portion 33 and a clamping portion 34 extending perpendicular from one end of the C-shaped portion 33. The C-shaped portions 33 of the C-shaped clamping members 32 are adapted to embrace the microphone stand 6 and the clamping portions 34 are adapted to bring the C-shaped portions 33 together against the microphone stand 6. The C-shaped portions 33 of the C-shaped clamping members 32 are positioned in spaced relation to enable each of the C-shaped clamping members 32 to be brought tightly against the microphone stand 6 without the C-shaped portions 33 of the C-shaped clamping members 32 contacting one another.

As best illustrated in FIGS. 4 and 6, it can be shown that the compression means 38 comprises a threaded fastener 70 fitted through aligned holes 35, 36, and 37 provided in the clamping portions 34 of the C-shaped clamping members 32. The threaded fastener 70 comprises a round head bolt 71 having a square neck 72, and a wingnut 73 threaded onto the round head bolt 71. One of the holes 35 is square for receiving and retaining the square neck 72 of the round head bolt 71.

In use, the C-shaped portions 33 of the pair of opposed C-shaped clamping members 32 are positioned against the microphone stand 6 and the round head bolt 71 is inserted through the aligned holes 35, 36, and 37 provided in the clamping portions 34. The tuner bracket 20 is positioned at any height along the microphone stand 6 that is comfortable and convenient for the user. The wingnut 73 is threaded onto the round head bolt 71 and tightened to clamp the C-shaped clamping members 32 tightly against the microphone stand 6. The electronic guitar tuner 2 is positioned on the top surface 22 of the shelf portion 21 of the tuner bracket 20 such that the instrument cable 4 rests on the stepped-up portion 28 of the tuner bracket 20. The electronic guitar tuner 2 is removably and securely held on the tuner bracket 20 by the hook and loop fastener 61.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A Guitar Tuner Holder for holding an electronic guitar tuner on a microphone stand, comprising:

a tuner bracket including a shelf portion having a top surface and a stepped-up portion at one end of said shelf portion, said shelf portion supporting said electronic guitar tuner; and a clamping means attached to said tuner bracket for clamping said tuner bracket to said microphone stand.

2. The Guitar Tuner Holder of claim 1, further comprising:

a tuner securing means for removably and securely holding said electronic guitar tuner on said shelf portion of said tuner bracket.

3. The Guitar Tuner Holder of claim 2, wherein said tuner securing means comprises a hook and loop fastener comprising a hook portion provided on an underside of said electronic guitar tuner and a loop portion provided on said top surface of said shelf portion of said tuner bracket.

4. A Guitar Tuner Holder for holding an electronic guitar tuner on a microphone stand, comprising:

a tuner bracket adapted to securely hold said electronic guitar tuner; and a clamping means attached to said tuner bracket for clamping said tuner bracket to said microphone stand, wherein said tuner bracket includes a shelf portion and a stepped-up portion provided at one end of said shelf portion for supporting an instrument cable extending from said electronic guitar tuner.

5. The Guitar Tuner Holder of claim 1, wherein said clamping means comprises:

a base portion, a pair of opposed C-shaped clamping members extending from said base portion, and a compression means for compressing and clamping said pair of opposed C-shaped clamping members tightly against said microphone stand.

6. The Guitar Tuner Holder of claim 4, further comprising:

a tuner securing means for removably and securely holding said electronic guitar tuner on said shelf portion of said tuner bracket.

7. The Guitar Tuner Holder of claim 6, wherein said tuner securing means comprises a hook and loop fastener including a hook portion provided on an underside of said electronic guitar tuner and a loop portion provided on a top surface of said shelf portion of said tuner bracket.

8. The Guitar Tuner Holder of claim 4, wherein said clamping means comprises:

a base portion, a pair of opposed C-shaped clamping members extending from said base portion, and a compression means for compressing and clamping said pair of opposed C-shaped clamping members tightly against said microphone stand.

9. A Guitar Tuner Holder for holding an electronic guitar tuner on a microphone stand, comprising:

a tuner bracket adapted to securely hold said electronic guitar tuner; and a clamping means attached to said tuner bracket for clamping said tuner bracket to said microphone stand, said clamping means including a base portion, a pair of opposed C-shaped clamping members extending from said base portion, and a compression means for compressing and clamping said pair of opposed C-shaped clamping members tightly against said microphone stand, wherein each of said pair of opposed C-shaped clamping members includes a C-shaped portion adapted to embrace said microphone stand, and a clamping portion extending perpendicular from one end of said C-shaped portion to said base portion, said clamping portion adapted to bring said C-shaped portion of each of said pair of opposed C-shaped clamping members together against said microphone stand, said C-shaped portion of each of said pair of opposed C-shaped clamping members positioned in spaced relation to enable said pair of opposed C-shaped clamping members to be brought tightly against said microphone stand without said C-shaped portion of each of said pair of opposed C-shaped clamping members contacting one another.

10. The Guitar Tuner Holder of claim 9, wherein said clamping portion of each of said pair of opposed C-shaped clamping members has an aligned hole therethrough and wherein said compression means comprises a threaded fastener fitted through said aligned hole provided in said clamping portion of each of said pair of opposed C-shaped clamping members.

11. The Guitar Tuner Holder of claim 10, wherein said threaded fastener comprises a round head bolt and a wingnut threaded onto said round head bolt.

12. The Guitar Tuner Holder of claim 11, wherein said round head bolt has a square neck and wherein said aligned hole provided in said clamping portion of one of said pair of opposed C-shaped clamping members is square for receiving and retaining said square neck of said round head bolt.

13. The Guitar Tuner Holder of claim 9, wherein said tuner bracket comprises a shelf portion having a top surface.

14. The Guitar Tuner Holder of claim 13, further comprising:

a tuner securing means for removably and securely holding said electronic guitar tuner on said shelf portion of said tuner bracket.

15. The Guitar Tuner Holder of claim 14, wherein said tuner securing means comprises a hook and loop fastener comprising a hook portion provided on an underside of said electronic guitar tuner and a loop portion provided on said top surface of said shelf portion of said tuner bracket.

16. The Guitar Tuner Holder of claim 13, wherein said tuner bracket further comprises a stepped-up portion provided at one end of said shelf portion for supporting an instrument cable extending from said electronic guitar tuner.

* * * * *